US005996987A

United States Patent [19]

Leu et al.

[11] Patent Number: 5,996,987

[45] Date of Patent: Dec. 7, 1999

[54] DEVICE FOR FEEDING PRINTED PRODUCT TO A FURTHER PROCESSING POINT

[75] Inventors: Willy Leu, Pfäffikon; Hans Frei, Oetwil am See, both of Switzerland

[73] Assignee: Ferag AG, Hinwil, Switzerland

[21] Appl. No.: 08/833,944

[22] Filed: Apr. 14, 1997

[30] Foreign Application Priority Data

May 6, 1996 [CH] Switzerland ..... 1146/96

[51] Int. Cl.[6] ..... B65H 5/22

[52] U.S. Cl. ..... 271/3.11; 271/3.08; 271/3.03; 271/3.02

[58] Field of Search ..... 271/3.12, 3.07, 271/4.08, 93, 104, 107, 31.1, 11.9, 3.11, 271, 151, 315

[56] References Cited

U.S. PATENT DOCUMENTS

| | | | |
|---|---|---|---|
| 4,071,234 | 1/1978 | Schick | 271/11 |
| 4,330,978 | 5/1982 | Willenbring et al. | 53/435 |
| 4,708,333 | 11/1987 | Servi et al. | 271/91 |
| 5,042,792 | 8/1991 | Honegger et al. | 271/188 |
| 5,071,110 | 12/1991 | Arnone et al. | 271/104 |
| 5,224,197 | 6/1993 | Helmstadter | 271/1 |
| 5,377,967 | 1/1995 | Eberle | 271/11 |
| 5,398,920 | 3/1995 | Leu | 271/3.1 |
| 5,443,254 | 8/1995 | Reist | 271/225 |
| 5,542,656 | 8/1996 | Stauber | 271/11 |
| 5,664,770 | 9/1997 | Keller | 271/12 |
| 5,720,587 | 2/1998 | Dietschi et al. | 271/270 |

*Primary Examiner*—Donald P. Walsh
*Assistant Examiner*—Daniel K. Schlak
*Attorney, Agent, or Firm*—Brinks Hofer Gilson & Lione

[57] ABSTRACT

The uppermost printed product is lifted from an intermediate stack, that was loaded from below, by a suction arrangement. The lifted product is fed into the active range of a pushing arrangement that is driven in synchronism with the suction arrangement. The pushing arrangement has stops which are arranged one behind another at a distance and circulate along a closed peripheral path and function to push the printed products released by the suction arrangement, one after another, by acting on the trailing edge of the printed products. The printed products are conveyed from the intermediate stack into the effective range of a conveying apparatus.

13 Claims, 3 Drawing Sheets

DEVICE FOR FEEDING PRINTED PRODUCT TO A FURTHER PROCESSING POINT

BACKGROUND OF THE INVENTION

The present invention relates to a device for feeding printed products, that are preferably folded and arrive in an imbricated formation, to a further processing point.

A device of this general type is disclosed in U.S. Pat. No. 5,664,770 that issued on Sep. 9, 1997, which application is hereby included by reference as a part of this disclosure. That application discloses an intermediate stack that is formed from printed products supplied by a first conveying device. The first conveying device has a driven conveying wheel around which a pressure belt engages and which has a plurality of cutouts uniformly distributed on the periphery. A suction arrangement, which is also arranged above the stacking point is driven in synchronism with the conveying wheel. The suction arrangement lifts the uppermost printed product of the intermediate stack and introduces it, with a region adjacent to one edge of the printed product, into a cutout in the conveying wheel. The conveying wheel deflects the printed product by means of bending into the conveying gap formed by the conveying wheel and pressure belt. In this known device, the suction arrangement must move around the edge of the printed product fed into the effective range of the conveying wheel, which occupies a certain amount of time. Moreover, the printed products are bent considerably by the conveying wheel. At high speeds this presents the risk of damaging the printed product.

BRIEF DESCRIPTION OF THE INVENTION

It is therefore the object of the present invention to provide a device for feeding printed products which arrive in an imbricated formation to a further processing point, which device combines high processing capacity with careful handling of the printed products.

This invention comprises a first conveying apparatus for supplying the printed products in an imbricated formation which might have irregularities and in which each printed product rest on the following one.

This invention also comprises a suction arrangement to lift a trailing edge of the uppermost printed product of the intermediate stack and places it into the effective range of a pushing arrangement.

This invention further comprises a device that delivers printed products to a stacking point at which a stack is formed from the printed products and a suction arrangement which is arranged above the stacking point.

This invention also comprises a suction arrangement and a pushing arrangement, said pushing arrangement is driven in synchronism with said suction arrangement and functions to push printed products that are released by the suction arrangement in a discharge conveying direction with a leading edge being in front, into the effective range of a second conveying apparatus.

Since the printed products are pushed from the intermediate stack, they pass outside the effective range of the suction arrangement, and the suction arrangement does not have to travel around the relevant printed product. This provides a device that requires little space for the movement path of the suction arrangement and also the arranging of a plurality of suction heads, circulating along the same movement path, that occupy a small mutual spacing. A high processing capacity and quiet running device is achieved by this invention. Since consecutive printed products are pushed to a second conveying apparatus by stops arranged at a distance one behind another, the formation of a uniform imbricated formation is achieved.

In a preferred embodiment of the device the discharge conveying speed of the second conveying apparatus is higher than the peripheral speed of the stops. In this embodiment the printed products are conveyed away very rapidly from the range of action of the stops, which prevents damage to the printed products during the moving of the stops away from the movement path of the printed products.

Another embodiment of the invention ensures the reliable formation of a regular imbricated formation at any processing speed and even if the whole device is stopped from time to time.

A particularly simple feature of this invention comprises a pushing arrangement that includes a cam roll whose cam-like projections are distributed peripherally thereof and form the stops that function to push the printed product.

In another preferred embodiment of the invention, the alignment of the printed products is maintained, such that the leading edge of the printed products continues to lead even when being conveyed away. The flat side of the printed products which lies underneath remains lying underneath and each printed product rests on the following one even in the conveying away imbricated formation.

In a further preferred embodiment of the invention the rest elements in the conveying range of the first conveying apparatus form a rest for the intermediate stack. This prevents damage to the lowest printed product in the intermediate stack by the first conveying apparatus.

This invention provides for an extremely simple matching of the device to the format of the printed products to be processed as a result of the rest element being displaceable in the conveying direction of the first conveying apparatus Another preferred embodiment of this invention comprises a nozzle arrangement for introducing an air jet between the printed product lifted by the suction arrangement and the intermediate stack which ensures damage-free shifting of the uppermost printed product of the intermediate stack, even if the printed products stick to one another.

A further preferred embodiment of the invention comprises retaining means for the temporary retention of the uppermost printed product in the intermediate stack while the preceding printed product is being pushed away from the intermediate stack which allows a variable buffer capacity of the intermediate stack. As a result, phase shifts and also short-term differences in the cycle rate of the accumulating printed products and of the further processing point, and gaps in the accumulating imbricated formation, can be accommodated.

DETAILED DESCRIPTION OF THE PREFERRED INVENTION

Figure 1:
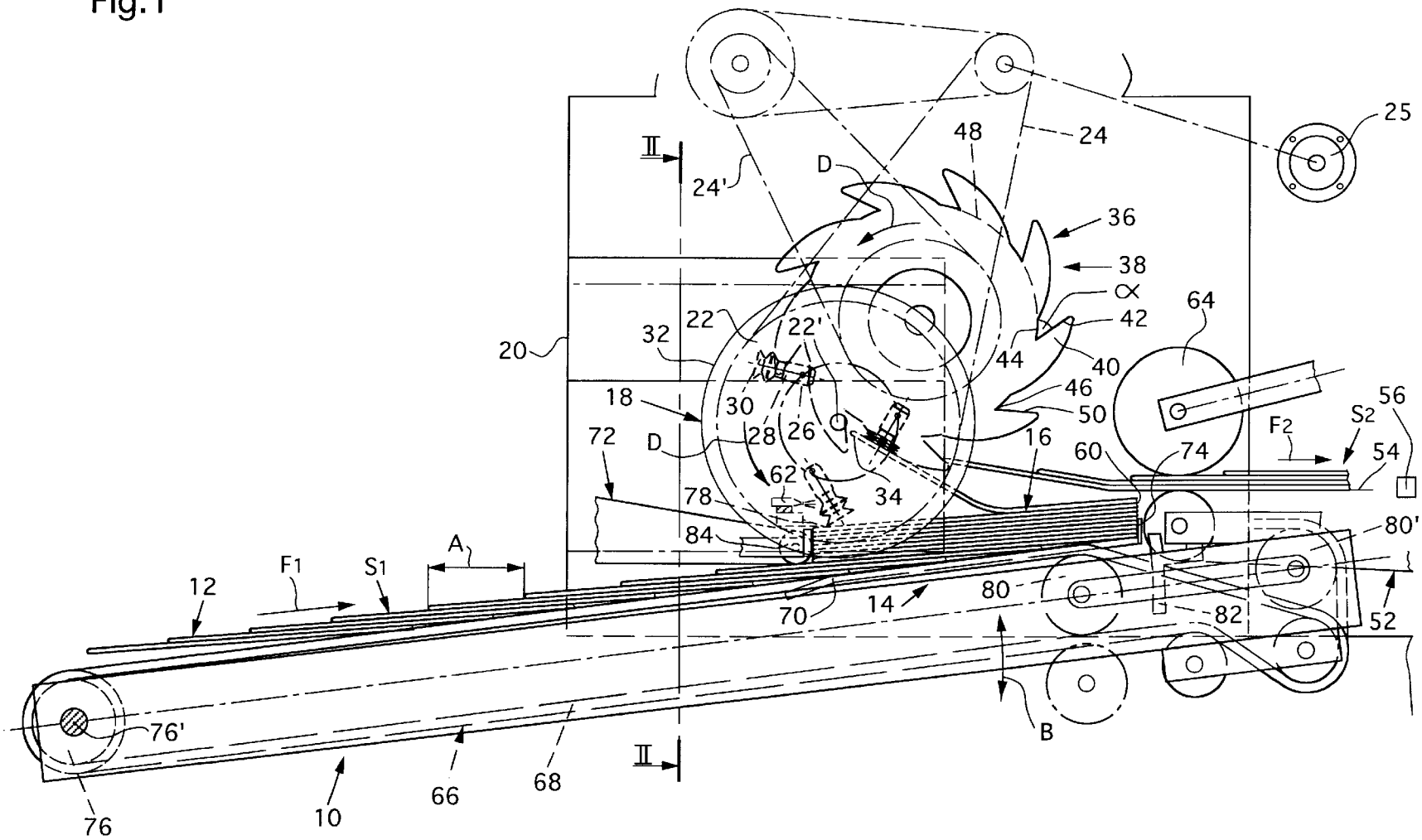
FIG. 1 is an elevation view of the device for feeding printed products accumulated in an imbricated formation to a further processing point according to the invention.
Figure 2:
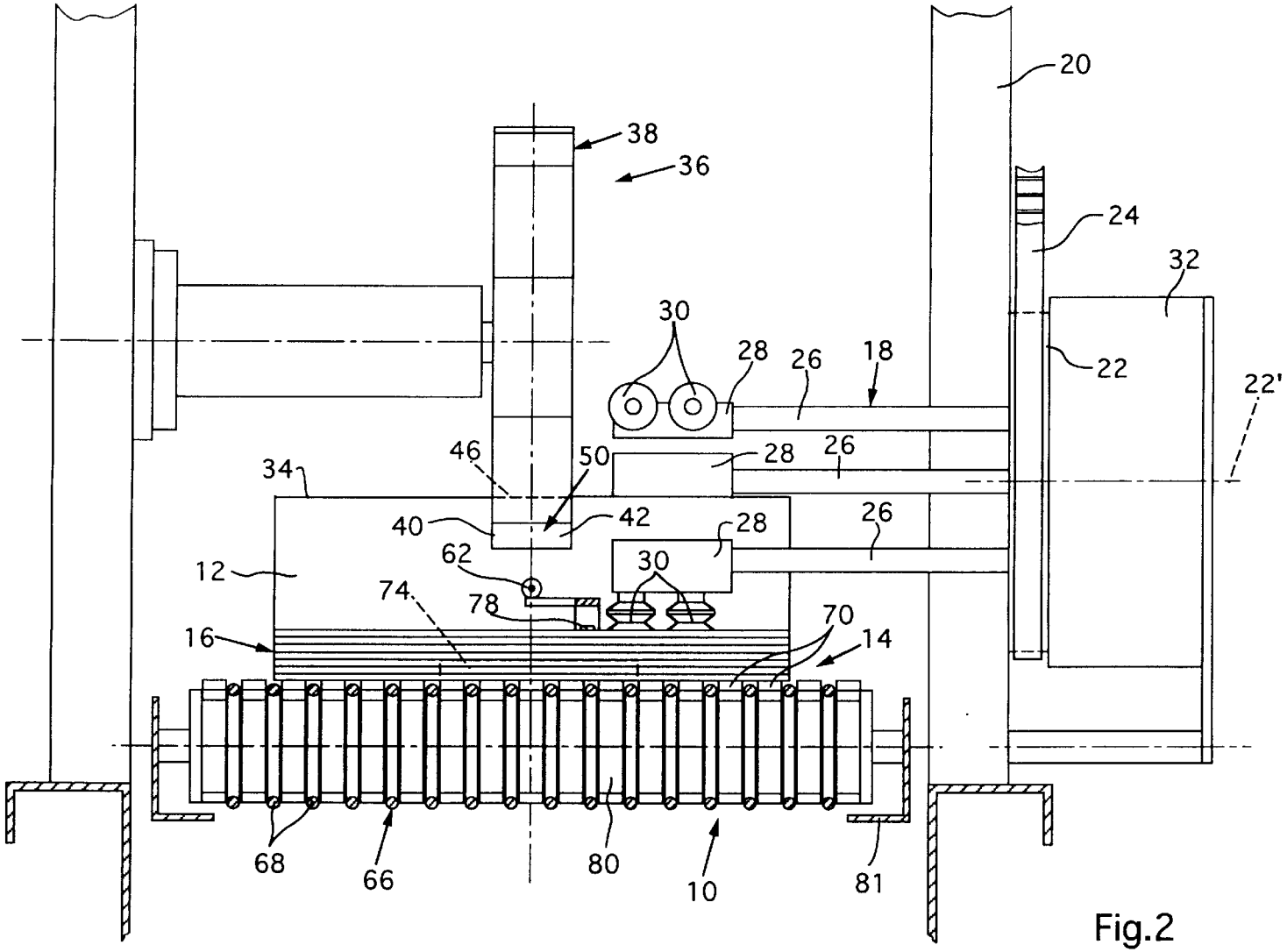
FIG. 2 is a section view of the device shown in FIG. 1 taken along the line 11—11 in FIG. 1.

The device shown in FIGS. 1 and 2 has a first conveying apparatus 10 which is intended to feed printed products 12 accumulating in an imbricated formation $S_1$ to a stacking point 14 in the conveying direction $F_1$. In the imbricated formation $S_1$, each printed product rests on the following one. This enables the formation of an intermediate stack 16, loaded from below, to be formed at the stacking point 14.

The imbricated formation $S_1$ can have irregularities, that is the spacing A between mutually corresponding edges of successive printed products 12 can be different. Thus, it is possible for two or more printed products 12 to lie congruently on one another or there may be gaps present.

Arranged above the stacking point 14 is a suction arrangement 18 for example, the type shown in U.S. Pat. No. 5,542,656, which patent is hereby included by reference as a part of this disclosure. With regard to the construction and the mode of operation of the suction arrangement 18, reference is expressly made to this document. The suction arrangement 18 has a rotor 22 which is connected via a belt drive 24 to a drive motor 25. Rotor 22 has three axles 26, which extend parallel to the axis of rotation 22' of the rotor 22, that are mounted to freely rotate. The axles 26 are each located the same distance from the axis of rotation 22' and uniformly distributed in the peripheral direction. A pivot arm 28, is carried by each axle 26 at its free end. As best seen in FIG. 2, two suction heads 30, are fixed to each pivot arm 28 which is mounted to rotate. The rotor 22 is rotatably mounted in a housing 32 that is fastened to a machine frame 20. A control device, not shown, for pivoting the axles 26 as a function of the rotational position of the rotor 22 is provided in said housing 32. When the rotor 22 is rotated in the direction of arrow D, the suction arrangement 18 is intended to come to rest, with a suction head 30 carried by one of the axles 26, from above onto the respectively uppermost printed product 12 of the intermediate stack 16. The suction heads 30 came to rest, adjacent to one edge 34 of the printed product 12. The suction heads 30 lift the gripped printed product 12 by edge 34, and moves the gripped printed product 12 away from the intermediate stack 16. The remaining printed products 12 being virtually not displaced in relation to one another. By means of the suction arrangement 18, the gripped printed product 12 is fed with its edge 34 into the active range of a pushing arrangement 36 which is driven in synchronism with the suction arrangement 18 and is also arranged above the stacking point 14.

The pushing arrangement 36 has a cam roll 38 which is connected via a second belt drive 24' to the driven motor 25. Cam roll 38 is rotatably driven in the same direction rotation D as rotor 22. Cam roll 38 has cam-like projections 40 uniformly distributed in the peripheral direction. The flank 42, of the cam like projections 40 lead as the cam roll 38 rotates in the direction D. The flanks 42 of each projection 40 extend at an acute angle $\alpha$ to a circular roll core 44. The edge region formed by the roll core 44 and the leading flank 42 forms a stop 46 for the edge 34 of the printed product 12. The stops 46 thus run around along the closed circulating path 48 and are arranged at a constant distance behind one another.

The projections 40 further form with their leading flank 42 a supporting element 50 for engagement with the under surface of the printed product 12. The supporting elements 50 prevent the printed product 12 from falling down following release by the suction arrangement 18.

As best seen in FIG. 2, when viewed at right angles to the conveying direction $F_1$, the cam roll 38 is located approximately in the middle of the intermediate stack 16. The suction heads 30 circulate at a location that is laterally offset a small distance from the cam roll 38.

Figure 4:
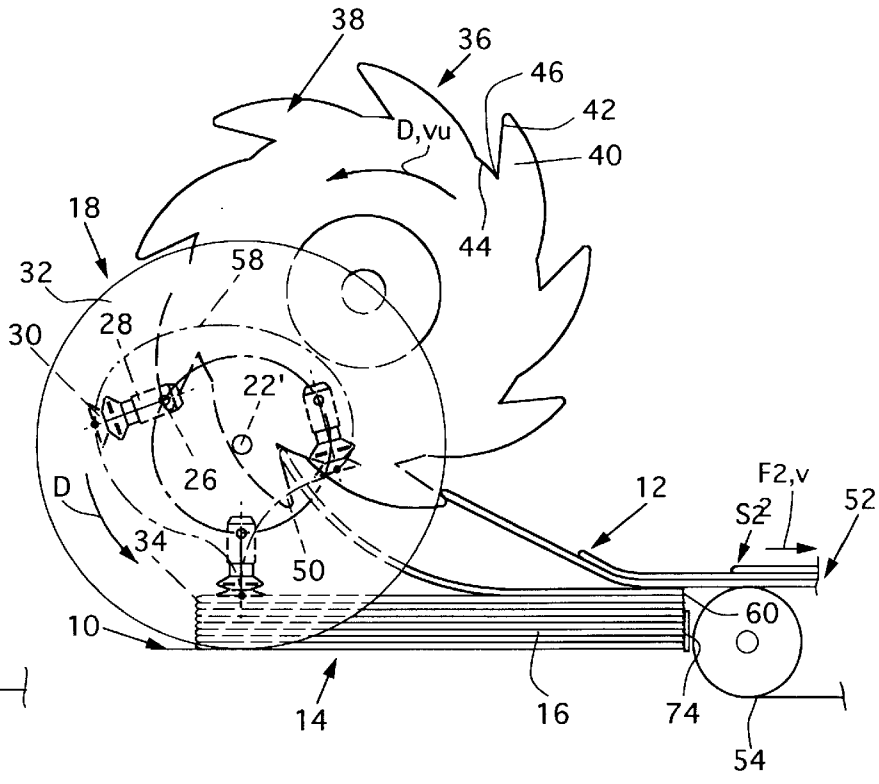
FIGS. 3 and 4 show part of the device seen in FIG. 1 at two different times in a working cycle.
Figure 3:
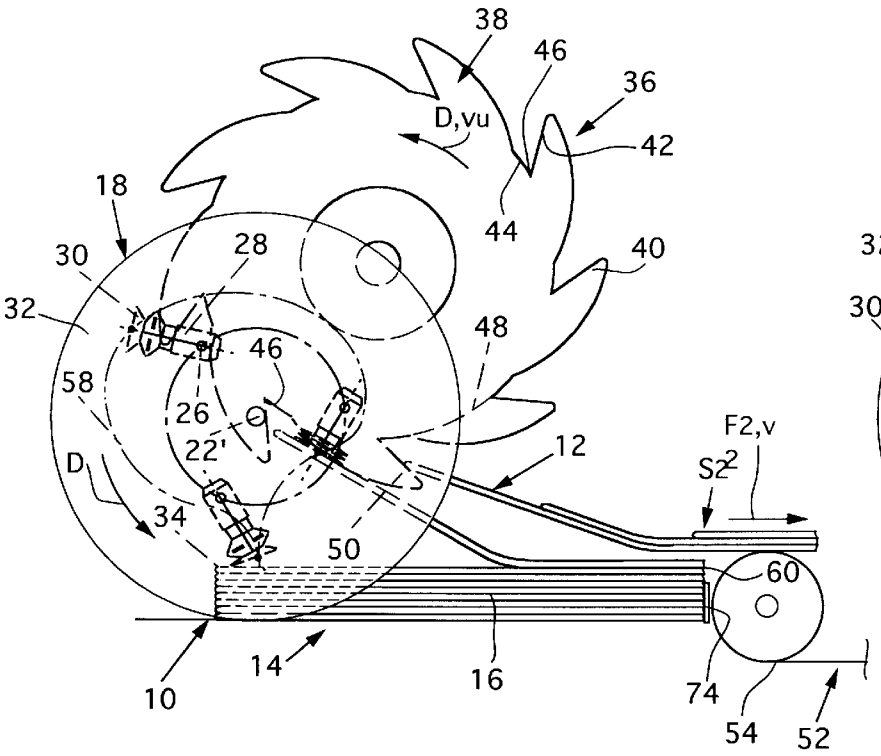

As best seen in FIGS. 3 and 4, a second conveying apparatus 52 is mounted downstream, in the conveying direction $F_1$, of the stacking point 14. Second conveying apparatus 521 is designed as a belt conveyor 54. The end of conveying apparatus 52, seen in FIGS. 3 and 4, is located adjacent to the upper side of the intermediate stack 16, and its end remote from the stacking point 14 is located at a further processing point, indicated in FIG. 1, by the reference symbol 56. The drive of the second conveying apparatus 52 is matched to the speed of rotation of the drive motor 25.

The interaction between the suction arrangement 18 and pushing arrangement 36 can be best seen in FIGS. 3 and 4. In these Figures simplified illustrations are used of the intermediate stack 16 and the belt conveyor 54, the suction arrangement 18 and the cam roll 38 to better show their interactive relationship. The pear-like movement path 58 of the suction heads 30 is also indicated in these figures by chain-dotted lines. Said movement path, with a downwardly directed tip, defines a gripping point for the printed products 12 and, if viewed in elevation, intersects the circulation path 48 of the stops 46.

As can be seen from FIG. 4, in each case one pair of suction heads 30 rests from above at the gripping point on the flat side of the uppermost printed product 12 of the intermediate stack 16. The gripping point is adjacent to the trailing edge 34, when viewed in the conveying direction $F_2$. The pair of suction heads 30 attaches itself firmly to the uppermost printed product 12 as a result of its connection to a source of reduced pressure. As the suction arrangement 18 rotates, in the direction of rotation D of the rotor 22, the pair of suction heads 30 that have gripped the uppermost printed product moves along an approximately circular section of its movement path 58. The pair of suction heads 30 move to the point of intersection of the movement path 58 with the circulation path 48 of the stops 46. There is a deposit point, in the vicinity of this intersection, printed product 12 that is retained by the pair of suction heads 30. The cam roll 38, which is also driven in the direction of rotation D, now engages under this printed product 12 with a projection 40 (FIG. 3). After engagement of the printed product 12 by the projection 40 the source of reduced pressure is disconnected from the pair of suction heads 30 that are gripping the product 12. As a result of the radius of the essentially circular section of the movement path 58 being substantially smaller than the dimension of the printed products 12 the printed product 12 substantially maintain their position when being lifted off the stack 16.

As soon as a stop 46, as a result of the rotation of the cam roll 38, strikes the trailing edge 34 of the printed product 12, the printed product 12 is pushed away from the stack 16 in the conveying direction $F_2$. This causes the leading edge 60, which is opposite the trailing edge 34, to be pushed into the active range of the second conveying apparatus 52 (FIG. 4). Since the conveying speed $v_2$ of the second conveying apparatus 52 is higher than the peripheral speed $v_U$ of the stops 46, the printed products 12 are pulled by the second conveying apparatus 52 out of the active range of the projections 40. This is important because it avoids, even when there is a very high speed rotation of the cam roll 38, damage to the printed products 12 by projections 40.

Following the release of a printed product 12 by the suction arrangement 18, the following pair of suction heads 30 is ready to grip the next printed product 12 of the intermediate stack 16, as indicated in FIG. 4. Following the release of a printed product 12, the relevant suction heads 30 move along the movement path 58, back into the take-over position. While moving along the movement path 58 the suction heads 30 pivot about the axle 26 upon which it is carried. The gripping of this next printed product 12 by the following suction heads 30, prevents this printed product 12 being carried along by frictional engagement by the preceding printed product 12. This task, of preventing a printed product 12 from being carried along by frictional engagement by the preceding printed product, could be undertaken by a retaining element which is separate from the suction heads 30 and is not shown.

Since the pushing away of the printed products 12 from the intermediate stack 16 is carried out by the stops 46, which are arranged at a fixed spacing, an extremely uniform imbricated formation $S_2$ is formed.

The printed products 12 shown are folded printed products, such as periodicals, newspapers and the like, or parts thereof, the fold forming the edge 34 in the vicinity of which the suction heads 30 engage. This ensures that even multi-sheet printed products 12 can be processed without problems.

As can be seen in FIG. 2, there is arranged at the rear end, viewed in the conveying direction $F_2$, of the stacking point 14 a nozzle arrangement 62 that is carried by a support on the machine frame 20. Nozzle arrangement 62 functions to introduce an air jet between the printed product 12, lifted by means of suction heads 30, and the intermediate stack 16, which enables the easy pushing away of the printed product 12 from the intermediate stack 16. Thus, nozzle arrangement 62 enables the release of a printed product 12 even if the printed products 12 have the tendency to stick to one another. As a result the continuation of the process of gripping and pushing away further printed products 12 from the intermediate stack 16 is not impaired.

In the initial region of the second conveying apparatus 52, a weight roller 64 cooperates with the belt conveyor 54. As soon as the leading edge 60 of the printed product 12, pushed from the intermediate stack 16, moves into the gap between the weight roller 64 and the belt conveyor 54, it is carried along in a precisely defined manner by the second conveying apparatus 52. The second conveying apparatus also contributes to the formation of the regular imbricated formation $S_2$.

As can be best seen in FIG. 2, the first conveying apparatus 10 includes a tape conveyor 66 including a plurality of tapes 68. At the stacking point 14, there are arranged between the tapes 68, and extending at least approximately parallel thereto, rod-like rest elements 70. Rest elements 70 project vertically upwardly of the tapes 68. Rest elements 70, in their initial region, are bent in the downward direction in order to form a ramp for the printed products 12 that are being received at the stacking point 14. The elements thus form a rest for the intermediate stack 16 in the active range of the first conveying apparatus 10.

A freely rotating pressure belt 72 cooperates with the tape conveyor 66, to ensure secure insertion from below of the printed products 12 into the intermediate stack 16. Viewed in the conveying direction $F_1$, a stop 74 is fastened to supporting elements 70 at the end of the stacking point 16. As a result of the first conveying apparatus 10, the printed products 12 that are supplied to the intermediate stack 16 are brought to rest with their leading edge 60 on this stop 74. Thus, even at very high processing speeds, the formation of a good qualitatively intermediate stack 16 is ensured. As a result of the intermediate stack 16 resting on the rest elements 70, damage to the printed products 12 by the tapes 68 is reliably prevented.

The first conveying apparatus 10 is a rocking conveyor. First conveying apparatus can be pivoted about the axle 76' of the deflection roll 76 for the tapes 68, in the direction of the double arrow B (FIG. 1). As a result of such pivoting the rest elements 70 can be raised and lowered, in order to ensure, irrespective of the height of the intermediate stack 16, that its upper side is always located at substantially the same level. This enhances the gripping of the respectively uppermost printed product 12 by the suction heads 30. A height sensor 78 (FIG. 2) picks off, at the trailing edge 34, the position of the uppermost printed product 12 of the intermediate stack 14. The pivoting position of the first conveying apparatus 10 is controlled by means of the signal from this height sensor 78.

The rest elements 70 and a deflection roll 80, for the tapes 68 are arranged on a carriage 81 (FIG. 2), which can be displaced in the longitudinal direction of the tape conveyor 66. The second conveying apparatus 52 is also displaced together with the carriage 81, which enables trouble-free matching of the device to the processing of different formats of printed products 12. The trailing edge 34 of the printed products 12 in the intermediate stack 16 and thus the suction arrangement 18 and pushing arrangement 36 can remain at the same point, irrespective of the format of the printed products being processed. The position of deflection roll 80, during the processing of the largest format printed products 12, is indicated in FIG. 1 with broken lines and is identified by 80'. The tapes 68 are preferably made of a resilient material, so that the change in length as a result of the displacement of the deflection roll 80 can be accommodated by the elongation of tapes 68.

Furthermore, there is arranged on the belt conveyor 54 a stop element 82 (FIG. 1) which, prevents printed products 12 projecting out of the intermediate stack 16 from become jammed in the event of a disturbance. The stop element 82 become effective when the stack 16 has a relatively great height which causes the first conveying apparatus 10 to be pivoted downward. The stop element 82 is displaceable together with the belt conveyor 54.

Another stop element 84 (FIG. 1) is provided underneath the nozzle arrangement 62. Stop element 84 is fastened to the machine frame 20 and cooperates with the product trailing edges 34 for the purpose of stabilizing the intermediate stack 16.

In another embodiment of this invention, the cams forming stops 46 in the pushing arrangement 36 are arranged at a fixed spacing in an inherently closed pulling element, for example a chain or a belt.

In another embodiment of this invention, as viewed in FIG. 1, the first conveying apparatus 10 is arranged such that the printed products 12 are supplied to the stacking point 14 from the right to the left underneath the second conveying apparatus 52. In this embodiment, the edge which leads in the imbricated formation $S_1$ becomes the trailing edge in the imbricated formation $S_2$.

The suction arrangement can also be of a design which is different from that shown.

We claim:

1. A device for feeding printed products, which arrive in an imbricated formation, to a further processing point:

a first conveying apparatus for supplying the printed products in a conveying direction in an imbricated formation, the imbricated formation might have irregularities and each printed product of the imbricated formation rests on the following printed product;

said first conveying apparatus delivers the printed products to a stacking point at which an intermediate stack, loaded from below, is formed from the printed products;

a suction arrangement;

a pushing arrangement;

a second conveying apparatus;

said suction arrangement located above the stacking point and functions to lift a trailing edge, seen in a discharge conveying direction, of the uppermost printed product of the intermediate stack and move it into the effective range of said pushing arrangement;

said pushing arrangement being driven in synchronism with said suction arrangement, and likewise located above said stacking point;

said pushing arrangement including stops having a peripheral speed, said stops arranged one behind another at a distance along a closed peripheral path and function to push the printed products released by the suction arrangement at the trailing edge, in the discharge conveying direction with a leading edge that is opposite said trailing edge being in front, into the effective range of said second conveying apparatus.

2. The device as claimed in claim 1, wherein said second conveying apparatus has a discharge conveying speed which is higher than said peripheral speed of the stops.

3. The device as claimed in claim 1, wherein each of said stops includes supporting element which projects forward, seen in the direction of rotation, and is adopted to engage underneath the relevant printed product, that was raised by said suction arrangement.

4. The device as claimed in claim 1, wherein said pushing arrangement includes a cam roll having a plurality of cam-like projections spaced peripherally thereof, said stops being formed by said cam roll and said plurality of cam-like projections.

5. The device as claimed in claim 4, wherein each of said stops includes a supporting element which projects forward beyond the stop, as seen in the direction of rotation, said supporting elements function to engage the underneath of the relevant printed product, that has been raised by said suction arrangement, said which supporting elements being a portion of said cam-like projections.

6. The device as claimed in claim 5, wherein said second conveying apparatus has a discharge conveying speed which is higher than said peripheral speed of the stops.

7. The device as claimed in claim 5 wherein the invention further includes retaining means for the temporary retention of the respective uppermost printed product in the intermediate stack while the preceding printed product is being pushed away from the intermediate stack.

8. The device as claimed in claim 1, wherein the conveying direction of the first conveyor is in the same direction as the discharge conveying direction.

9. The device as claimed in claim 1, wherein the first conveying apparatus has a tape conveyor including a plurality of tapes between which are located rest elements for the intermediate stack, said rest elements being located at the stacking point.

10. The device as claimed in claim 9, wherein the rest element are displaceable as seen in the conveying direction of the first conveying apparatus.

11. The device as claimed in claim 1, which comprises a nozzle arrangement for introducing an air jet between the printed product respectively lifted by means of the suction arrangement, and the intermediate stack.

12. The device as claimed in claim 1, wherein the first conveying apparatus is designed to be able to be raised and lowered at the stacking point in order to compensate for a change in height of the intermediate stack.

13. The device as claimed in claim 1, which comprises retaining means for the temporary retention of the respective uppermost printed product in the intermediate stack while the preceding printed product is being pushed away from the intermediate stack.

* * * * *